United States Patent [19]

Hagey

[11] 4,410,770

[45] Oct. 18, 1983

[54] DIRECTIONAL MICROPHONE

[75] Inventor: Lee Hagey, Buchanan, Mich.

[73] Assignee: Electro-Voice, Incorporated, Buchanan, Mich.

[21] Appl. No.: 271,621

[22] Filed: Jun. 8, 1981

[51] Int. Cl.[3] ..... H04R 1/31

[52] U.S. Cl. ..... 179/121 D; 179/1 DM; 181/285; 181/158; 181/151; 181/290; 381/92

[58] Field of Search ..... 181/158, 151, 242, 290, 181/160, 166, DIG. 1; 179/121 D, 1 DM

[56] References Cited

U.S. PATENT DOCUMENTS 3,115,207 12/1963 Wiggins ..... 179/121 D 3,240,883 3/1966 Seeler ..... 179/121 D 4,094,380 6/1978 Kobayashi et al. ..... 181/290

*Primary Examiner*—G. Z. Rubinson

*Assistant Examiner*—Robert Lev

*Attorney, Agent, or Firm*—Burmeister, York, Palmatier, Hamby & Jones

[57] ABSTRACT

A unidirectional dynamic microphone provided with a first sound path to the forward side of the diaphragm and a second sound path to the rear side of the diaphragm in which the second sound path has a chamber coupled to a second chamber associated with the diaphragm through a distributed acoustic RC damping assembly.

7 Claims, 7 Drawing Figures

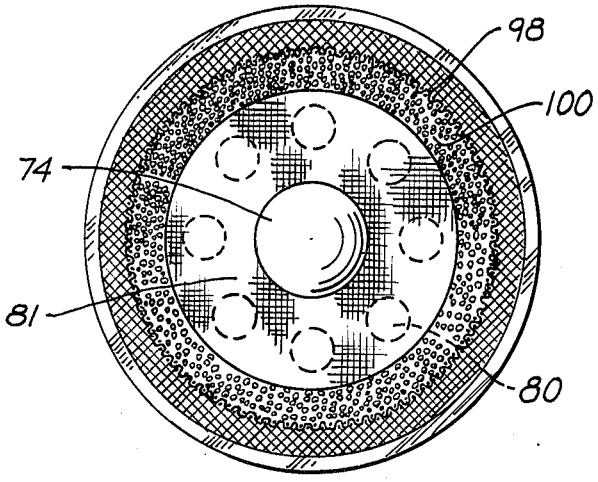
FIG. 3
FIG. 4
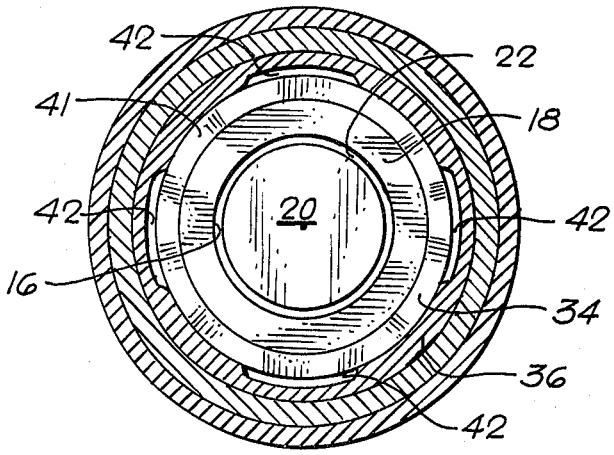
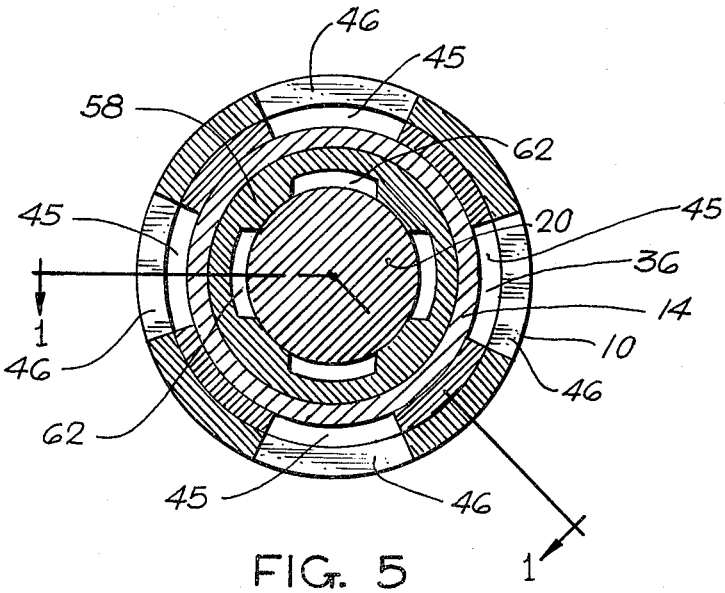
FIG. 5

DIRECTIONAL MICROPHONE

The present invention relates generally to microphones and particularly to directional microphones.

For many sound applications, it is desirable to use a directional microphone. This is particularly true of vocalists or concert performers employing a sound enhancing public address system. A directional microphone is nonresponsive to sounds emanating from the back of the microphone, and hence a performer facing the audience will automatically be using the microphone in a position to minimize feedback from the loudspeakers of the public address system. Often the performer will also utilize the microphone close to the mouth, thereby permitting the sound system to be operated at low microphone gain and minimizing the likelihood of feedback. However, the frequency response of many directional microphones is different when used close to the mouth of the performer than it is for a remote use in that the bass response is significantly increased due to such proximate use of the directional microphone.

One type of directional microphone frequently used employs a front sound entry port which is acoustically coupled to the forward side of the diaphragm of an electroacoustic transducer and a second port acoustically communicating with the rear side of the diaphragm, thereby providing a frontal sound path and a rearward sound path. Phase shifting elements are placed in the rearward sound path to shift the phase of sound impinging upon the diaphragm from the second port in order to provide substantial cancellation for sound waves originating behind the diaphragm. In this manner, a cardioid polar response pattern is achieved for the microphone.

The acoustic elements used to achieve the phase shift in the rearward path to the diaphragm and the path length from the rear side of the diaphragm, provide differing phase shifts for different frequencies, so that it is difficult for engineers to achieve a cardioid response pattern over a wide range of frequencies. It is known that the cardioid response pattern may be extended in frequency range by providing a third sound path to the rearward side of the diaphragm, the third path coupling a closed chamber to the rear side of the diaphragm through an acoustical resistance element. While such microphones have extended the frequency range in which cardioid polar patterns can be achieved, the phase shifting elements adversely affect the response of the microphone at certain frequencies, and further, fail to achieve cardioid polar response patterns over wide frequency ranges.

U.S. Pat. No. 3,240,883 to Seeler seeks to further improve the frequency range in which a cardioid polar response pattern can be achieved in such microphones by adding a second chamber to the third path to the rear side of the diaphragm, the second chamber being acoustically coupled to the first chamber through an acoustical resistance element. The addition of the second chamber in the third path to the rearward side of the diaphragm of the Seeler microphone provides additional acoustical parameters which may be adjusted in an effort to smooth out the response of the microphone at those frequencies which vary from the desired frequency response curve.

The efforts of the prior art to extend the frequency range of cardioid polar response for microphones providing separate sound paths to the forward and rearward sides of a diaphragm have thus lead to more complicated and more costly structures. It is an object of the present invention to provide a directional microphone which employs a transducer with a diaphragm and sound paths to the forward and rearward side of the diaphragm which is simpler in construction and which provides a more uniform polar response for a wider range of frequencies than has been achieved by microphones in the prior art.

For a more complete description of the present invention and a preferred embodiment of the present invention, reference is made to the drawings, in which:

FIG. 3 is a sectional view taken along the line 3–3 of FIG. 1;

FIG. 4 is a sectional view taken along the line 4—4 of FIG. 1;

FIG. 5 is a sectional view taken along the line 5—5 of FIG. 1;

Figure 1:
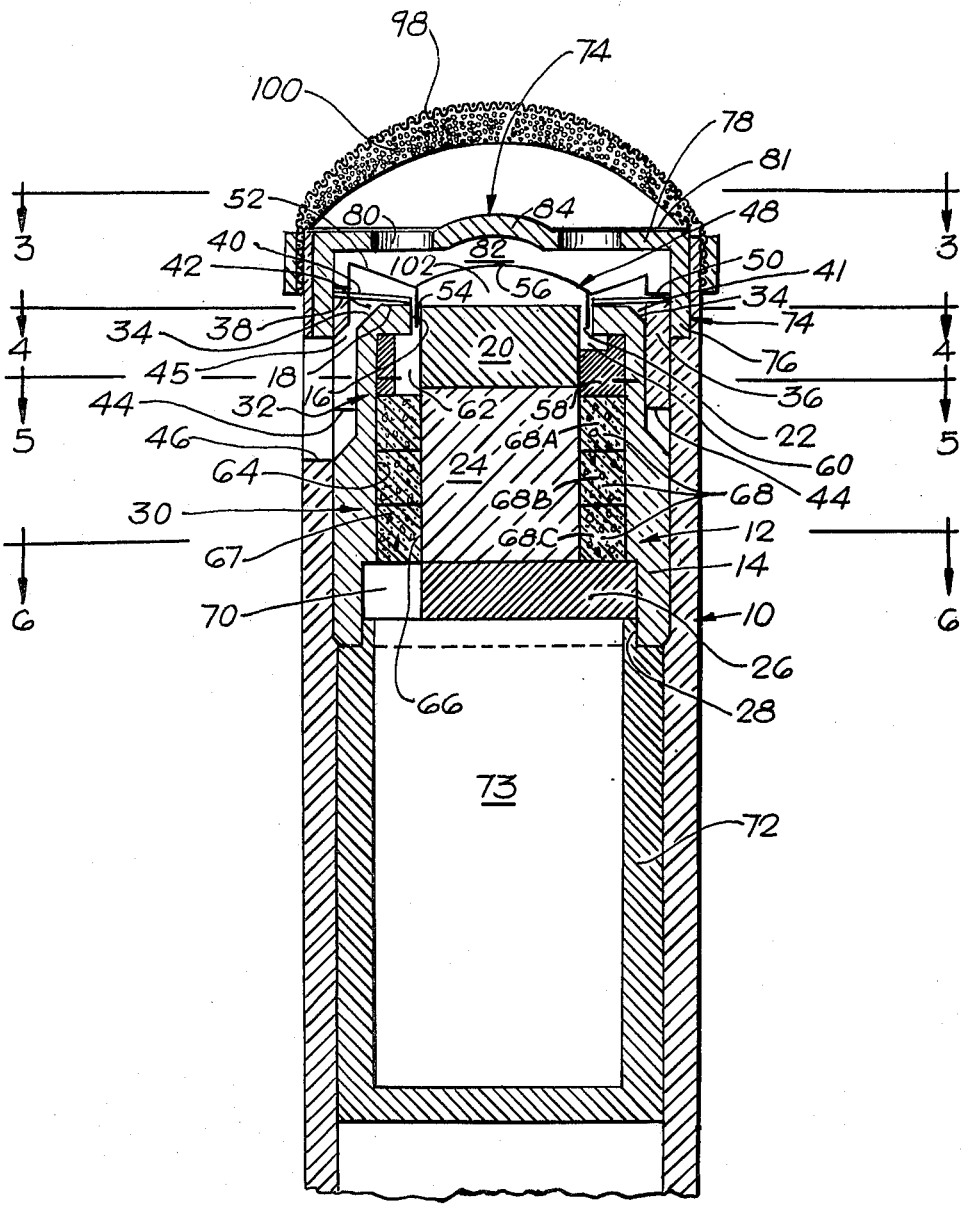
FIG. 1 is a longitudinal central sectional view of a microphone constructed according to the present invention, the plane of the figure being shown in FIG. 5 and the figure being broken away to omit conventional elements forming no part of the present invention.
Figure 2:
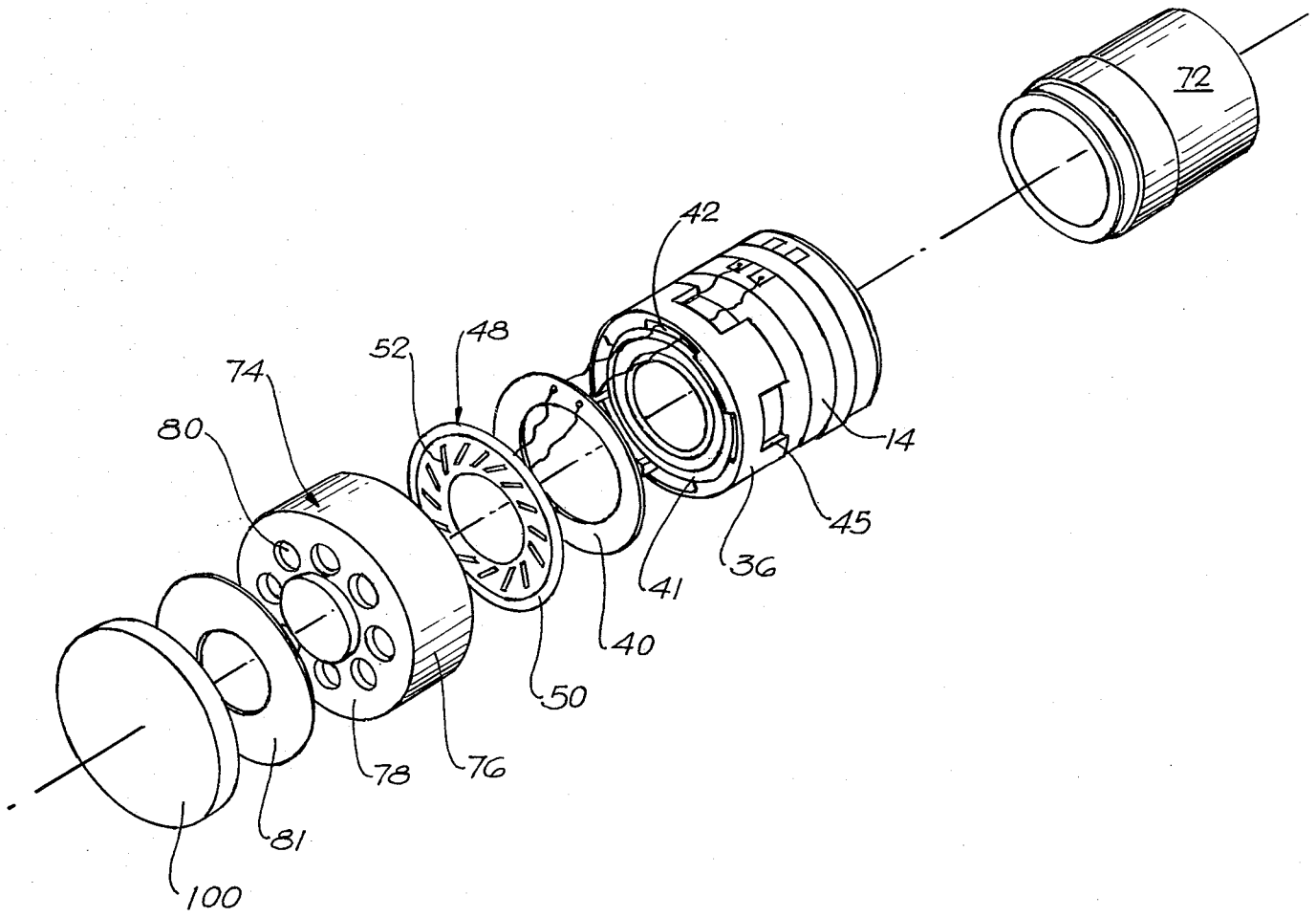
FIG. 2 is an exploded view of the elements of the acoustical transducer illustrated in FIG. 1.
Figure 6:
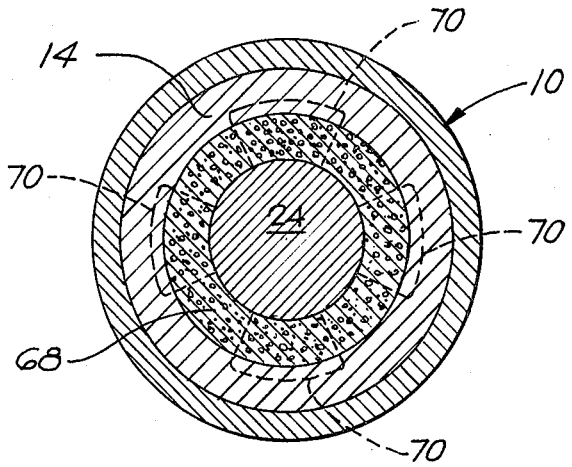
FIG. 6 is a sectional view taken along the line 6—6 of FIG. 1.

As illustrated in FIGS. 1 and 3 through 6, the microphone has a casing 10 which encompasses and houses a transducer structure 12. The transducer structure 12 has a hollow cylindrical pot 14 with a cylindrical opening 16 extending coaxially therein from a flat end wall 18. A cylindrical pole piece 20 is disposed coaxially within the opening 16 and has a smaller diameter than the opening 16 to form an annular gap 22. The pole piece 20 is mounted on a magnet 24, which in turn is secured in position by a backplate 26 mounted within the pot 14 at the end thereof opposite the end wall 18. The backplate 26 is mounted in a second cylindrical opening 28 located at the opposite end of the pot 14.

The pot 14 has two portions 30 and 32 disposed along the longitudinal axis which are coaxial but of different diameters, the portion 30 being of larger diameter than the portion 32. Further, a beveled surface 34 in the form of a conical segment extends between the end wall 18 and the surface of the second portion 32 of the pot 14, and a cylindrical ring 36 extends about the perimeter of the second portion 32 of the pot. The ring 36 has a circular end surface 38 disposed slightly forward of the end wall 18 of the pot 14, and a layer 40 of acoustical resistance material, such as cloth or felt, is mounted on the end surface 38 of the ring 36 and the end wall 18 of the pot 14. Hence, the layer 40 extends across a circular groove 41 formed by the beveled surface 34 and ring 36.

A plurality of slots 42 are disposed at equal spaced intervals in the inner surface of the ring 36, each slot 42 being parallel to the central axis of the ring 36, and extending from the end surface 38 to a rectangular recess 45 which extends from the opposite surface 44 of the ring between the inner and outer cylindrical surfaces thereof. The casing 10 is provided with an aperture 46 confronting each of the recesses 45, thereby providing a plurality of sound paths from the exterior of the casing, each path extending through a slot 42 and the circular groove 41 to the layer 40 of acoustical resistance material.

A diaphragm 48 is mounted on the layer 40 of acoustical resistance material by means of a flat ring portion 50 at the perimeter of the diaphragm, the ring portion being mounted on the opposite side of the layer 40 from the end surface 38 of the ring 36. The diaphragm 48 has a plurality of flutes 52 which extend inwardly from the ring portion 50. The flutes 52 extend inwardly to a cylindrical voice coil 54 which is disposed in the gap 22 between the pole piece 20 and the opening 16 in the pot 14. A central dome 56 completes the diaphragm 48.

The pole piece 20 is maintained coaxially in the opening 16 by means of a cylindrical collar or centering member 58 disposed between the inner surface of the pot 14 and the cylindrical surface of the pole piece 20. The collar 58 is provided with a circular recess 60 extending from its inner surface at the end confronting the gap 16, and a plurality of equally spaced slots 62 extend into the collar 58 from the inner surface thereof parallel to the central axis of the collar. The slots 62 provide acoustical communication between the gap 16 and the interior of the pot 14. In the particular microphone illustrated, there are four apertures 46 in the casing which communicate with four slots 42, and there are also four slots 62 in the collar 58.

The region between the inner wall 64 of the pot 14 and the cylindrical surface 66 of the magnet 24 is a cavity 67 of revolution, and this cavity 67 is filled with a plurality of washers 68 of acoustical damping material, each of the washers 68 having a rectangular cross section and filling a portion of the cavity 67. In the particular embodiment described in this specification, three such washers 68 are illustrated and the washers 68 are constructed of open cellular foam polyurethane.

The backplate 26 is provided with a plurality of peripheral recesses 70, each of the recesses 70 being aligned with one of the slots 62 in the collar 58. A cup 72 with an internal cavity 73 is mounted on and extends from the pot 14, and the recesses 70 provide acoustical communication between the cavity 67 between the walls 64 and 66 and the cavity 73 in the interior of the cup 72.

The diaphragm 48 is enclosed within a cap 74 which has a cylindrical wall 76 mounted outwardly on the ring 36 and extending to the side of the diaphragm 48 opposite the ring 36. The cap 74 also is provided with a disc 78 which extends across the end of the cylindrical wall 76 opposite the ring 36 to confront the diaphragm 48, and the disc 78 is provided with a plurality of spaced apertures 80 disposed in a circular configuration generally confronting the voice coil 54. The disc 78 has a central dome portion 84 cupped outwardly to conform with the contour of the dome 56 of the diaphragm 48. A circular screen 81 of fine meshed screen cloth is mounted on the surface of the disc 78 and covers the apertures 80 to prevent the entrance of foreign matter. The cap 74 and diaphragm 48 form a chamber 82 which functions with the apertures 80 to form a Helmholtz resonator in order to accentuate the high frequency response of the microphone.

A screen 98, in the shape of a dome, extends across the cap 74. A layer 100 of open cellular foam material is disposed adjacent to the screen 98 on the side thereof confronting the cap 78, and the layer 100 functions to attenuate sound bursts, thus preventing the microphone from responding with a sharp electrical pulse which reproduces as a sound "pop".

The microphone set forth in the figures is a single-D unidirectional microphone. The microphone has a forward sound path through the screen 98, the layer of open cellular foam 100, the screen 81 and the apertures 80 to permit sound to impinge upon the forward side of the diaphragm 48. In like manner, the sound field is permitted to impinge upon the rearward side of the diaphragm 48 through a first rear sound path which extends through the apertures 46 in the casing 10, the recesses 45, and the slots 42 in the ring 36, the layer 40 of acoustical resistance material to enter the region between the diaphragm 48 and the pole piece 20, this region being referred to as the diaphragm chamber and designated 102.

There is a second sound path to the rear of the diaphragm 48 and this is the path entering the diaphragm chamber 102 through the annular voice coil gap 22. Sound waves entering the diaphragm chamber 102 through this second sound path add vectorially with sound waves entering the diaphragm chamber 102 through the first rearward sound path, and this sound pressure sum produces a pressure gradient on the diaphragm 48 with sound pressure in the chamber 82 at the forward side of the diaphragm.

Three open cellular foam washers 68 disposed in the second path to the rear side of the diaphragm are essentially acoustical resistance elements, but nonetheless provide less absorption to low frequency sound waves than high frequency sound waves. Accordingly, sound waves entering the cylindrical passage formed between the wall 66 of the magnet 24 and the wall 64 of the pot 14 effectively penetrate that passage to a greater distance the lower the frequency, and for the lowest frequencies such sound waves pass through the recesses 70 to enter the cavity 73. The acoustical resistance of the washers 68 is a function of the density of the open cellular form material of the washer, the resistance increasing with increasing density. The inventor has found that the washer adjacent to the diaphragm chamber 102, designated 68A, may be relatively porous, and the washer remote from the diaphragm chamber 102, designated 68C, should be relatively less porous. The intermediate washer 68B preferably has a porosity between that of washers 68A and 68C. While various materials have been used for the washers 68, such as felt, open cellular foam polyurethane plastic of the type described in U.S. Pat. No. 3,236,328 has been found highly satisfactory.

Figure 7:
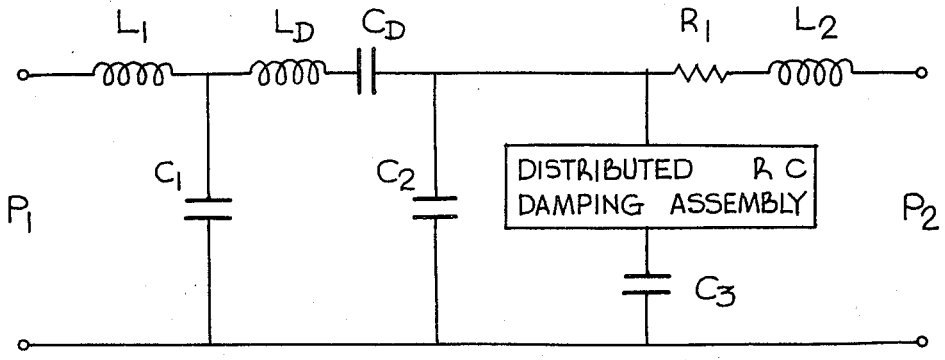
FIG. 7 is a schematic diagram illustrating the acoustical functions of the microphone of FIGS. 1 through 5 by way of electrical analogy.

FIG. 7 illustrates in an electrical analogy the operation of the microphone of FIGS. 1 through 6. Sound entering through the screen 98 into the chamber 82 is designated by the symbol $P_1$. The chamber 82 provides an acoustic capacitance in the electrical analogy indicated by the capacitor $C_1$, and an acoustical inductance designated by the equivalent inductor $L_1$. In like manner, the diaphragm chamber 102 has an acoustical capacitance designated in the analogy as $C_2$. The diaphragm itself has an inductance and capacitance represented in the analogy by $L_D$ and $C_D$. Sound entering through the apertures 46 is designated $P_2$ in FIG. 7, and the acoustical inductance of the first path to the rear side of the diaphragm is designated $L_2$. The acoustical resistance in the first path to the rear side of the diaphragm is largely the acoustical resistance afforded by the cloth layer 42 and is designated $R_1$. The third path to the diaphragm is represented in the electrical analogy of FIG. 7 by the capacitor $C_3$ and distributed RC damping assembly which are electrically connected across the capacitor $C_2$. The distributed RC damping assembly is the acoustical resistance and capacitance of the cylindrical passage formed between the wall 66 of the magnet 24 and the wall 64 of the pot 14 and the acoustical resistance washers 68A, 68B and 68C. From FIG. 7, it is apparent that the pressure gradient on the diaphragm is determined by the difference in the acoustical potentials developed across capacitors $C_1$ and $C_2$. The first path to the rear of the diaphragm is frequency dependent due to the presence of the inductance $L_2$, the higher the frequency the greater the acoustical impedance. This effect, however, is offset by the impedance of the acoustical capacitor $C_3$ and the distributed RC damping assembly.

Those skilled in the art will devise many uses for the present invention beyond that set forth in the foregoing specification. It is therefore intended that the scope of the present invention be not limited by the foregoing disclosure, but rather only by the appended claims.

The invention claimed is:

1. A directional microphone comprising a casing having a cavity therein, said casing having an opening communicating with the cavity, an electroacoustical transducer disposed within the cavity of the casing, said transducer having a vibratile diaphragm confronting the opening and being acoustically sealed on the casing to divide the cavity into a first portion confronting the opening and a second portion, means disposed in the second portion of the cavity defining a first chamber disposed on the side of the diaphragm opposite the opening and a second chamber, said casing having an aperture extending to the exterior thereof, and said chamber defining means being provided with a first passage from the first chamber to the aperture, and said chamber defining means being provided with a second passage extending between the first chamber and the second chamber, characterized by the improved construction wherein the second passage contains an elongated portion filled with a mass of acoustical resistance material, the density of said mass increasing with distance from the first chamber.

2. A directional microphone comprising the combination of claim 1 wherein the mass of acoustical resistance material comprises open cellular foam plastic.

3. A directional microphone comprising the combination of claim 1 wherein the mass of acoustical resistance material comprises a plurality of discrete members of substantially uniform density, said members being disposed in abutting relation along the axis of the second passage with each member extending across the second passage and abutting the chamber defining means, one of said members being disposed adjacent to the second chamber and another of said members being disposed adjacent to the first chamber, the one member having a higher density than the other member.

4. A directional microphone comprising the combination of claim 3 wherein the transducer has cylindrical voice coil translatably disposed in a cylindrical gap and the second passage is cylindrical and communicates with the gap, each of the members being ring shaped and having a rectangular cross section.

5. A directional microphone comprising the combination of claim 4 wherein the transducer has a cylindrical pole piece disposed within the voice coil and forming the inner wall of the magnetic gap, said pole piece being mounted on a cylindrical magnet and the pole piece and magnet forming the inner wall of the cylindrical second passage.

6. A directional microphone comprising the combination of claim 5 in combination with a rigid centering member mounted on the pole piece adjacent to the cylindrical gap, said centering member extending to the casing and having a plurality of channels extending therethrough to provide acoustical communication between the cylindrical second passage and the magnetic gap.

7. A directional microphone comprising the combination of claim 5 in combination with a second centering member mounted on the end of the magnet remote from the circular gap and on the casing, said second member having a plurality of openings extending therethrough to provide acoustical communication between the second chamber and the cylindrical passage.

* * * * *